US006725005B2

(12) United States Patent
Ueda et al.

(10) Patent No.: US 6,725,005 B2
(45) Date of Patent: Apr. 20, 2004

(54) DRIVE CONTROL METHOD OF PHOTORECEPTOR DRUM AND IMAGE FORMING APPARATUS

(75) Inventors: Tadayuki Ueda, Kokubunji (JP); Hiroyuki Maruyama, Hachioji (JP); Kenji Izumiya, Hachioji (JP); Ryuji Okutomi, Hino (JP); Shinobu Kishi, Hachioji (JP); Satoshi Ogata, Hachioji (JP); Eiji Nishikawa, Hachioji (JP); Jun Onishi, Hino (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 10/267,621

(22) Filed: Oct. 9, 2002

(65) Prior Publication Data

US 2003/0081965 A1 May 1, 2003

(30) Foreign Application Priority Data

Oct. 15, 2001 (JP) ..... 2001-316444
Dec. 19, 2001 (JP) ..... 2001-386002

(51) Int. Cl.[7] ..... G03G 15/00
(52) U.S. Cl. ..... 399/167
(58) Field of Search ..... 399/167, 49, 77; 318/636

(56) References Cited

U.S. PATENT DOCUMENTS 5,678,144 A * 10/1997 Osaki et al. ..... 399/167
6,501,930 B2 * 12/2002 Oku ..... 399/167
6,516,169 B2 * 2/2003 Niimi et al. ..... 399/159

* cited by examiner

*Primary Examiner*—Joan Pendegrass
(74) *Attorney, Agent, or Firm*—Frishauf, Holtz, Goodman & Chick, P.C.

(57) ABSTRACT

There is described a method of controlling the rotational peripheral speed of the rotating photoreceptor drum to make it constant. The method includes the steps of: detecting angular velocity signals by means of angular velocity detecting device disposed on an axis of the photoreceptor drum; finding deviations from a reference angular velocity, based on the angular velocity signals; storing a profile of the deviations within a one-revolution of the photoreceptor drum in a storage section, while revising the profile in real-time base; applying an arithmetic processing to an angular velocity signal detected at a current rotational-position of the photoreceptor drum by referring data included in the profile obtained in a preceding one-revolution of the photoreceptor drum; and controlling the motor, based on results of the arithmetic processing for the angular velocity signals, so as to compress the deviations from the reference angular velocity as small as possible.

11 Claims, 10 Drawing Sheets

DRIVE CONTROL METHOD OF PHOTORECEPTOR DRUM AND IMAGE FORMING APPARATUS

BACKGROUND OF THE INVENTION

This invention relates to an image forming apparatus for forming a toner image on a rotating photoreceptor drum by an electrophotographic method to carry out image formation and to a method of controlling the rotational peripheral speed of said rotating photoreceptor drum to make it constant.

In an image forming apparatus based on an electrophotographic method, it is put into practice that a toner image is formed on a rotating image carrying member made up of a photoreceptor drum or a photoreceptor belt and the formed toner image is directly or indirectly transferred onto a sheet of recording paper and fixed. In forming an image, image exposure is carried out by an image exposure means on an image carrying member which has been uniformly charged by a charging means, to form a latent image; in forming a latent image, if the peripheral speed of the image carrying member which is rotating at a constant speed fluctuates, some distortion of the formed image is brought about. Further, in a color image forming apparatus of a tandem type, a plurality of monochromatic images formed by the respective monochromatic image forming units are superposed together to form a color image on a sheet of recording paper, it is regarded as an essential condition for obtaining a good-quality color image that the image carrying members in the respective monochromatic image forming units have the same speed and have no speed fluctuation.

As regards the speed control of a photoreceptor drum, control methods using various kinds of speed detecting means have been proposed; however, if it is intended to control the angular speed of a photoreceptor drum in real time to make it constant, a rotational speed control method for practicing the control of rotational speed using an angular speed detecting means based on an encoder is used.

In the publication of the unexamined patent application H6-327278, for the angular speed control of a photoreceptor drum, it is proposed that the profile of the rotational fluctuation of a photoreceptor drum at a certain timing is measured by the use of a feedback control method or a feed-forward control method, and the angular speed control is carried out until the next specified sampling timing by using the data. This proposal has been done by taking it into consideration to control a factor of a rotating photoreceptor drum having no reproducibility by using a feedback control process. However, in the above-mentioned proposal, the control is such that only the factor of rotational fluctuation which happens to be generated during the sampling timing is suppressed. Further, as regards the feedback control, if it is intended to suppress a wide-range rotational fluctuation, a high-priced CPU, a high-resolution encoder, etc. are required, which makes the feedback control not realistic.

On the other hand, if a peripheral speed detecting means based on an encoder is used for the detection of the peripheral speed of an image carrying member, the structure becomes mechanically complex, and the speed detecting means becomes high in price. For a tandem-type color image forming apparatus, because a plurality of speed detecting means are required, this problem becomes more remarkable.

It is also an object of this invention to provide a rotational speed control method in which a speed detecting means based on an encoder is not used, marking is made on a rotary body such as an image carrying member by a writing means, and the speed control of the rotary body is performed by carrying out a low-cost high-precision peripheral speed detection based on the detection of the marking.

Further, in an image forming apparatus employing the above-mentioned speed control method, marking toner particles of the marking adhere to the circumferential surface of the image carrying member, and a problem of toner consumption being of large amount and a problem of the surface of the image carrying member being smudged are produced.

SUMMARY OF THE INVENTION

To overcome the abovementioned drawbacks in conventional image-recording apparatus, it is the first object of the present invention to provide a drive control method of a photoreceptor drum to actualize that rotational fluctuation of a photoreceptor drum is suppressed at a high-precision by the use of a repetition control method, and an image forming apparatus which carries out image formation using this drive control method.

Further, it is the second object of the present invention to provide an image forming apparatus by which the problem to be produced in employing a rotational speed control method is eliminated.

Accordingly, to overcome the cited shortcomings, the abovementioned objects of the present invention can be attained by motor controlling methods and image-forming apparatus described as follow.

(1) A method of controlling a motor for driving a photoreceptor drum, comprising the steps of: detecting angular velocity signals by means of angular velocity detecting device disposed on an axis of the photoreceptor drum, which is driven by the motor to form a latent image on its circumferential surface; finding deviations from a reference angular velocity, based on the angular velocity signals detected by the angular velocity detecting device; storing a profile of the deviations within a one-revolution of the photoreceptor drum in a storage section, while revising the profile already stored in the storage section in real-time base; applying an arithmetic processing to an angular velocity signal, being one of the angular velocity signals, detected at a current rotational-position of the photoreceptor drum currently rotating, by referring data included in the profile obtained in a preceding one-revolution of the photoreceptor drum; and controlling the motor, based on results of the arithmetic processing for the angular velocity signals, so as to compress the deviations from the reference angular velocity as small as possible.

(2) The method of item 1, wherein the data correspond to a same position as the current rotational-position or a position near the current rotational-position.

(3) The method of item 1, wherein the detecting step of detecting the angular velocity signals is commenced, after a rotational velocity of the motor reached to a target value, and then, a waiting time interval for stabilizing mechanical fluctuations of the motor has elapsed.

(4) An apparatus for forming an image, comprising: a photoreceptor drum to form a latent image on its circumferential surface; a motor to drive the photoreceptor drum; an angular velocity detecting device to detect angular velocity signals, the angular velocity detecting device being disposed on an axis of the photoreceptor drum; a controlling section to control the motor and to find deviations from a reference angular velocity, based on the angular velocity signals detected by the angular velocity detecting device; a storage section to store a profile of the deviations within a one-revolution of the photoreceptor drum in it, while revising the profile already stored in the storage section in real-time base; and an arithmetic processing section to apply an arithmetic processing to an angular velocity signal, being one of the angular velocity signals, detected at a current rotational-position of the photoreceptor drum currently rotating, by referring data included in the profile obtained in a preceding one-revolution of the photoreceptor drum; wherein the controlling section controls the motor, based on results of the arithmetic processing for the angular velocity signals, so as to compress the deviations from the reference angular velocity as small as possible.

(5) The apparatus of item 4, wherein the data correspond to a same position as the current rotational-position or a position near the current rotational-position.

(6) The apparatus of item 4, wherein the angular velocity detecting device commences detecting the angular velocity signals, after a rotational velocity of the motor reached to a target value, and then, a waiting time interval for stabilizing mechanical fluctuations of the motor has elapsed.

(7) The apparatus of item 4, wherein a diameter of the photoreceptor drum is an integral multiple of a diameter of a peripheral roller rotating in contact with the photoreceptor drum.

(8) An apparatus for forming an image, comprising: a photoreceptor drum to form a toner image on its circumferential surface; a motor to drive the photoreceptor drum; a mark writing device to intermittently write each of marks on the photoreceptor drum at constant time intervals; a mark detecting device to detect each of the marks written by the mark writing device; a storage section to store mark-interval values between the marks detected by the mark detecting device; an arithmetic processing section to calculate rotational characteristics of the photoreceptor drum from the mark-interval values stored in the storage section; and a controlling section to control the motor, based on the rotational characteristics of the photoreceptor drum, calculated by the arithmetic processing section, so as to keep a circumferential surface velocity of the photoreceptor drum as uniform as possible.

(9) The apparatus of item 8, further comprising: a mark cleaning device to clean the marks, written by the mark writing device and developed with toner on the circumferential surface of the photoreceptor drum, before transferring the toner image onto a recording medium; and a toner recycling section to collect toner cleaned by the mark cleaning device and to convey the toner to a developing section so as to reuse the toner for developing.

(10) The apparatus of item 8, wherein a full color toner image is formed by overlapping a plurality of unicolor toner images on an intermediate transfer belt or a recording medium, and each of the plurality of unicolor toner images is formed by each of a plurality of unicolor image forming units included in the apparatus; and wherein the photoreceptor drum is employed for each of the plurality of unicolor image forming units.

(11) The apparatus of item 8, further comprising: an image exposing section to expose an image onto the photoreceptor drum, so as to form a latent image, which is developed with toner to form the toner image; wherein the image exposing section also serves as the mark writing device.

(12) The apparatus of item 8, wherein the marks are written on a non image-forming area of the photoreceptor drum.

(13) The apparatus of item 8, further comprising: a time interval changeover section to change a value of the constant time intervals, at which each of the marks is intermittently written, corresponding to a rotational frequency of the photoreceptor drum.

(14) A method of controlling a motor for driving a rotational body, comprising the steps of: intermittently writing each of marks on the rotational body at constant time intervals by means of a mark writing device; detecting each of the marks, written by the mark writing device, by means of a mark detecting device; storing mark-interval values between the marks detected by the mark detecting device in a storage section; calculating rotational characteristics of the rotational body from the mark-interval values stored in the storage section by means of an arithmetic processing section; and controlling the motor by means of a controlling section, based on the rotational characteristics of the rotational body, calculated by the arithmetic processing section, so as to keep a circumferential surface velocity of the rotational body as uniform as possible.

(15) The method of item 14, wherein the controlling section includes a motor-drive changing section to change a motor-drive command value, based on a calculation result of the arithmetic processing section.

(16) The method of item 15, wherein the controlling section controls the motor so as to compensate a delay time generated at a time when the motor-drive command value is calculated from the rotational characteristics of the rotational body, based on a reading delay time value, from a writing position at which a mark, being one of the marks, is written by the mark writing device, to a detecting position at which the mark is detected by the mark detecting device.

(17) The method of item 16, wherein the motor-drive changing section changes the motor-drive command value, based on the rotational characteristics of the rotational body calculated within a preceding one-revolution of the rotational body, so as to keep the circumferential surface velocity of the rotational body at a constant value.

(18) The method of item 17, wherein, during a velocity controlling operation for the rotational body, the mark writing device constantly writes each of the marks and the mark detecting device constantly detects each of the marks, and the mark-interval values stored in the storage section are revised in a real time base while the reading delay time value is compensated for, to continuously perform the velocity controlling operation for next revolution of the rotational body.

Further, to overcome the abovementioned problems, other motor controlling methods and image-forming apparatus, embodied in the present invention, will be described as follow:

(19) A drive control method of a photoreceptor drum characterized by comprising the steps of: storing a one-rotation profile of a photoreceptor drum, which is rotated by a drive motor to carry out image formation, as renewed in real time on the basis of an angular speed signal detected by an angular speed measuring means mounted on the drum shaft of the photoreceptor drum; carrying out an operation processing of angular speed information detected at the present drum position of the rotating photoreceptor drum through reading out for reference the stored profile at the drum position of one rotation before or data in the neighborhood of that; and outputting an order value to said drive motor on the basis of the result of the operation processing.

Further, it is a desirable mode of practice that the acquisition of the aforesaid profile is started after the passage of waiting time from timing when the aforesaid drive motor reaches to the target speed to timing when the mechanical fluctuation is subsided.

(20) An image forming apparatus characterized by comprising: a photoreceptor drum rotated by a drive motor for carrying out image formation; an angular speed measuring means mounted on the drum shaft of said photoreceptor drum; a storage for storing a one rotation profile of the photoreceptor drum obtained by an angular speed signal detected by said angular speed measuring means as renewing it in real time; an operation processing section for carrying out an operation processing of angular speed information detected by said angular speed measuring means at the present drum position of the rotating photoreceptor drum through referring to the stored profile at the drum position of one rotation before or data in the neighborhood of that; and a control section for outputting an order value to said drive motor on the basis of the result of the operation by said operation processing section.

Further, it is a desirable mode of practice that the diameter of the aforesaid photoreceptor drum is in a relationship of an integral multiple with the diameter of a peripheral member rotating in contact with said photoreceptor drum.

(21) A rotational speed control method characterized in that a mark writing means for writing marks at constant intervals on a rotary body rotated by a drive motor, a mark detecting means capable of reading the written marks at any time, a storage means for storing the values of the intervals of the marks read by said mark detecting means, an operation processing means for calculating the rotational characteristic of the rotary body from the interval values of the marks stored in said storage means, and a motor drive changing means for carrying out the change over of the drive order values of said drive motor from a digitized result of the operation processing, are included in order to perform a drive controlling operation to make constant the peripheral speed of the rotary body.

(22) An image forming apparatus characterized by comprising: a mark writing means for writing marks at constant time intervals on a photoreceptor drum rotated by a drive motor for carrying out image formation; a mark detecting means capable of reading the written marks at any time; a storage means for storing the values of the interval of the marks read by said mark detecting means; an operation processing means for calculating the rotational characteristic of the photoreceptor drum from the interval values of the marks stored in said storage means; a motor drive changing means for changing over the drive order values of said drive motor from the digitized result of the operation processing; a cleaning means dedicated to the marks only for removing the marks which have been written by said mark writing means and visualized by a developing means before image transfer; and a recycling means for conveying toner particles collected by said cleaning means dedicated to the marks only to said developing means.

BRIEF DESCRIPTION OF THE DRAWINGS

Other objects and advantages of the present invention will become apparent upon reading the following detailed description and upon reference to the drawings in which.

DETAILED DESCRIPTION OF THE PREFERRED EMBODIMENT

Figure 1:
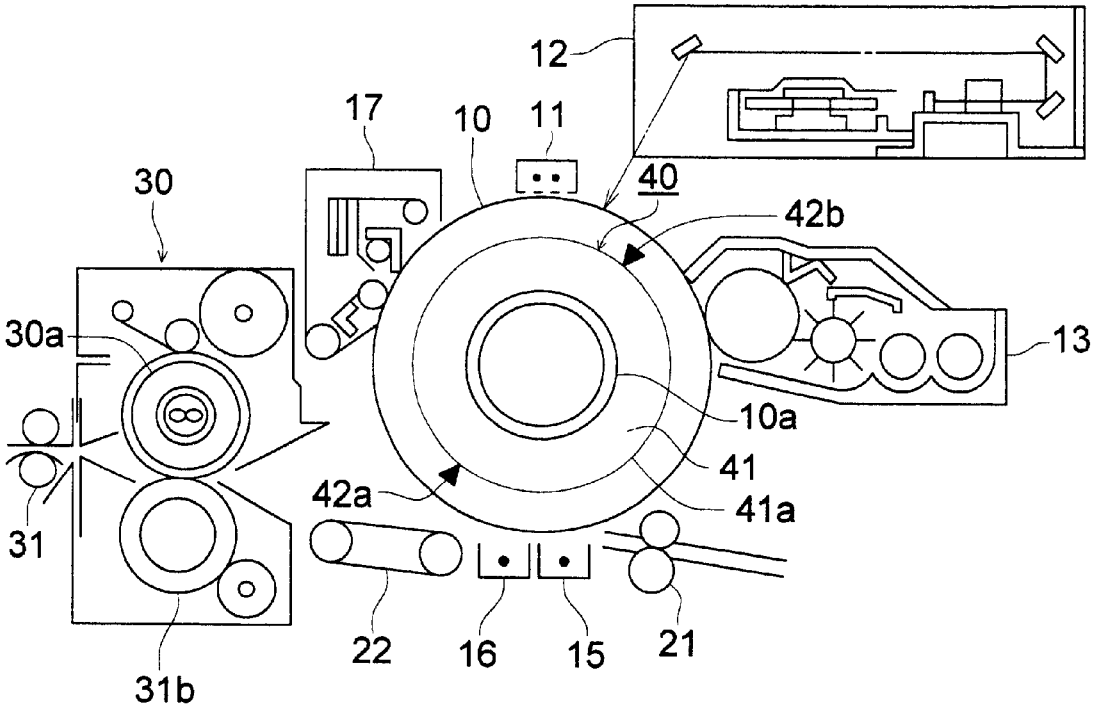
FIG. 1 is a cross-sectional view showing the structure of an image forming apparatus of this invention.

An image forming apparatus which carries out image formation by using a rotational speed control method of this invention while keeping the rotational angular speed of a photoreceptor drum 10 as an image carrying member will be explained with the use of the cross-sectional structure drawing shown in FIG. 1. In addition, this invention should not be limited to the image forming apparatus shown in FIG. 1, but it can be applied to any image forming apparatus which forms a toner image on an image carrying member by an electrophotographic method.

Around the rotating photoreceptor drum 10 for carrying out image formation, there are arranged a charging device 11, an image exposure device 12, a developing device 13, a transfer device 15, a detaching device 16, and a cleaning device 17. In forming an image, the peripheral surface of the photoreceptor drum 10 is uniformly charged by the charging device 11 made up of a scorotron charging device or the like. Subsequently, the image exposure device 12 modifies a laser beam on the basis of an image information signal and projects a light image on the uniformly charged photoreceptor surface, to form an electrostatic latent image. The electrostatic latent image is subjected to development by the developing device 13 to which a developing bias voltage is applied, and a toner image is formed on the photoreceptor drum 10.

On the other hand, a sheet of recording paper, which has been separated from the stack of sheets contained in a paper feed tray and conveyed, is once stopped at a pair of registration rollers 21, is conveyed in synchronism with the toner image formed on the photoreceptor drum 10, and reaches the transfer region.

By the transfer device 15, a bias voltage of the reverse polarity to the toner is applied from the back side of the transfer paper sheet in the transfer region, and the toner image on the photoreceptor drum 10 is transferred onto the recording paper sheet. To the recording paper sheet carrying the transferred toner image, an alternate-current bias voltage with a direct-current bias voltage superposed is applied and the recording paper sheet is detached from the photoreceptor drum 10. The residual toner particles on the photoreceptor drum 10 after the detachment of the recording paper sheet are removed from the surface of the photoreceptor by the cleaning device 17.

The recording paper sheet having the toner image transferred to it in the transfer region is conveyed on a conveyance belt 22, and is gripped and conveyed by a fixing device 30 comprising a heating roller 30*a* and a pressing roller 30*b*; during that time, the toner image is firmly bonded and fixed to the transfer paper sheet. After the finish of fixing, the recording paper sheet is ejected to the outside of the machine by a pair of ejection rollers 31.

An encoder 40 as an angular speed measuring means is mounted on the drum shaft 10*a* of the photoreceptor drum 10. The encoder 40 comprises a rotary disk 41 attached to the drum shaft 10*a* having a detection portion 41*a* composed of a number of slits arranged ring-wise at specified intervals in the part near the outer periphery of the disk, and speed detecting devices 42*a* and 42*b* are arranged at the positions corresponding to the detection portion 41*a*. It is put into practice that, by the arrangement of the two sensors of speed detecting devices 42*a* and 42*b* on a diametral line of the rotary disk 41 at the positions opposite to each other, and making the average of the detection values of the two sensors, the fluctuation of the angular speed is detected with a high precision.

Figure 2:
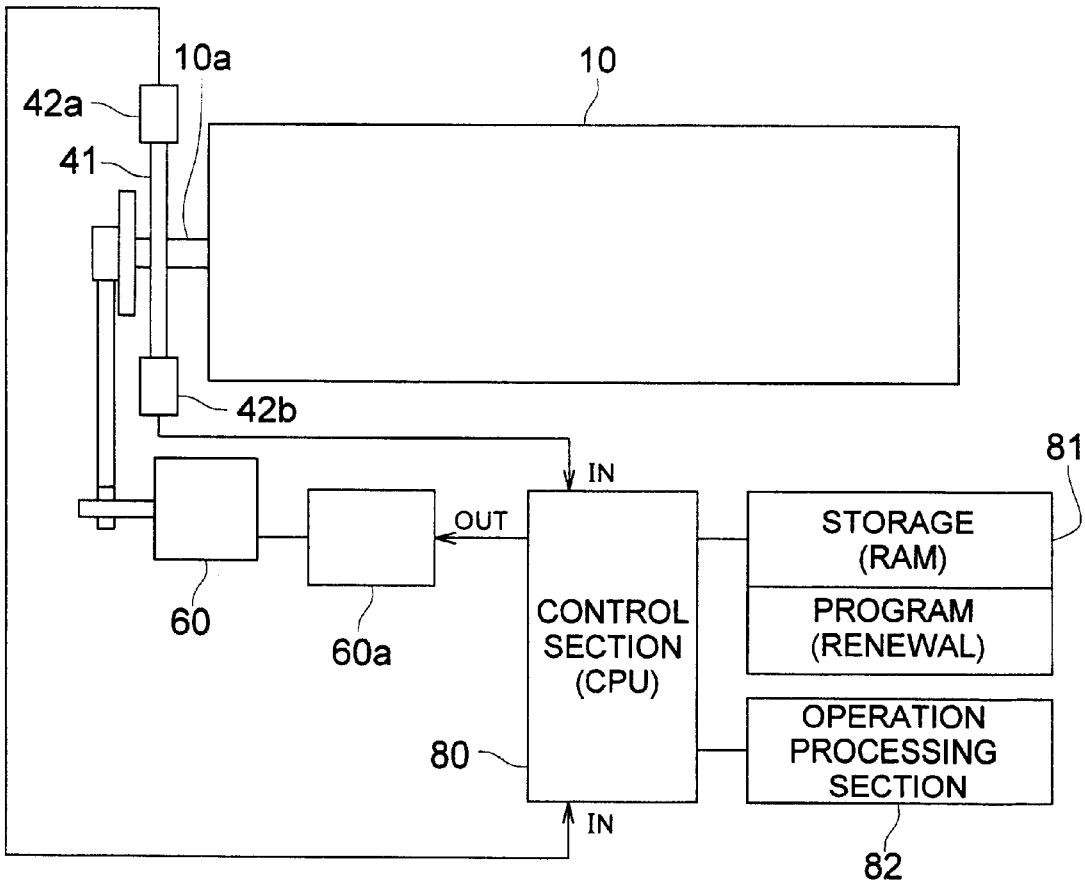
FIG. 2 is a block diagram showing a drive control of a photoreceptor drum.

FIG. 2 is a block diagram showing a drive control of the photoreceptor drum 10. For the photoreceptor drum 10 which is rotating in a steady state, the detection values detected by the speed detecting device 42 of the encoder 40 are inputted in the control section (CPU) 80, and the data detected during one rotation of the photoreceptor drum 10 are stored as renewed in real time in a storage (RAM) 81 as a profile (a map of angular speed deviations). The control section 80 carries out an operation processing of the angular speed information detected at the present drum position of the rotating photoreceptor drum 10 by an operation processing section 82 through reading out for reference the profile data at the drum position of one rotation before or the profile data in the neighborhood of it stored in the storage (RAM) 81, and outputs an order value to make a constant angular speed rotation to a drive circuit 60*a* of a drive motor 60 for driving the photoreceptor drum 10 on the basis of the result of the operation processing. Further, the angular speed deviation value at the present drum position is stored as the renewal of the angular speed deviation value a the drum position of one rotation before.

Figure 3:
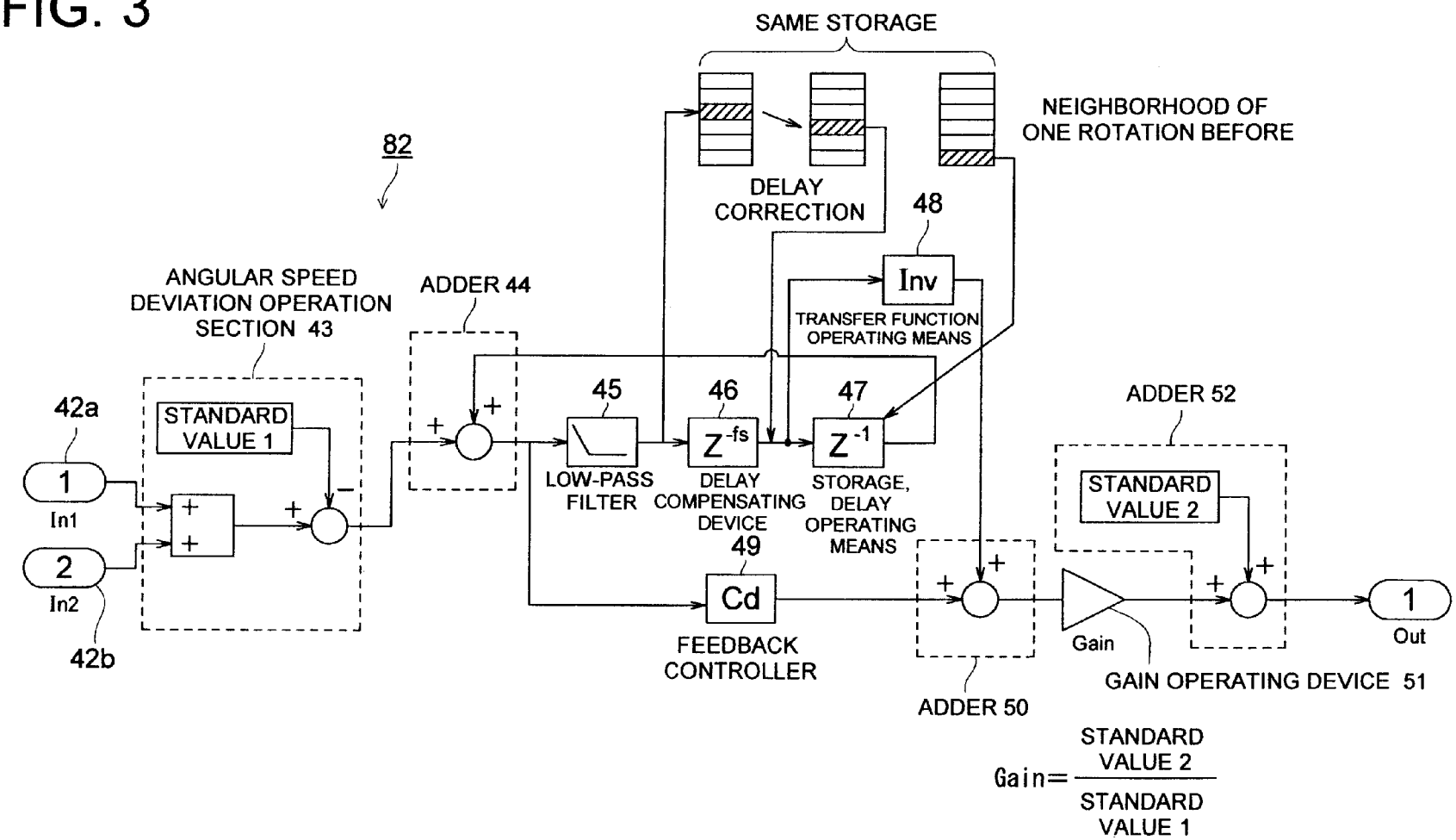
FIG. 3 is the circuit diagram of an operation processing section.
Figure 4:
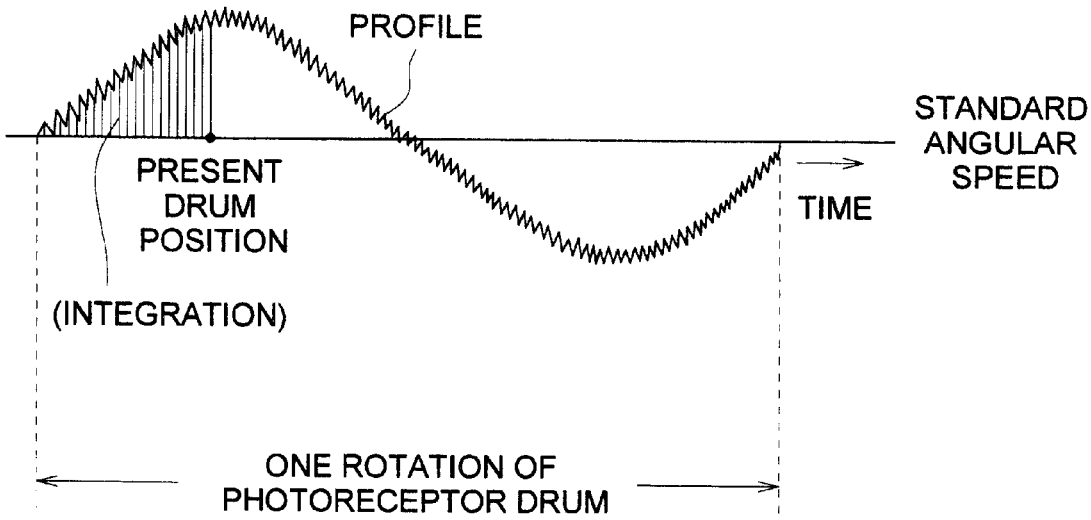
FIG. 4 is a schematic drawing of an angular speed deviation profile.

FIG. 3 shows the circuit diagram of the operation processing section 82, and FIG. 4 shows a schematic drawing of an angular speed deviation profile. As regards encoder signals inputted from the respective speed detecting devices 42*a* and 42*b*, after they are added to each other in the angular speed deviation operating section 43, the difference between the sum and the twice the standard value of the angular speed of the encoder is taken to calculate the deviation. For the calculated deviation, angular speed correction data which have been subjected to an operation processing one rotation before are operated by an adder 44, and the result of the operation is fed into a feed-forward loop and a feedback loop in parallel.

In the feed-forward loop, the signal is made to pass a low pass filter 45 determined by the cutoff frequency obtained from the transfer function of the object of control, and memory shift is carried out in a repetitive delay compensation device 46 in order to make an adjustment for the delay of one rotation.

As regards the data which have been shifted by the above-mentioned repetitive delay compensation means, data corresponding to the transfer function of the object of control are selected by a transfer function operating means 48, to become output data. Further, the data which have been subjected to the memory shift in the delay compensation device 46 are sent to the memory delay operating means 47 parallel to the transfer function operating means 48, and it is carried out the memory shift for the calculation of the neighborhood data of one rotation before for the next time.

In the feedback loop, a final output value is obtained through it that an operation in a feedback controller 49 is done, the result of it is added to the output of the above-mentioned feed-forward loop by an adder 50, a deviation adapted to the output value is calculated by a gain operating device 51, and the output standard value is added the deviation by an adder 52.

In addition, the above-mentioned feedback controller 49 generally means PI control (proportional plus integral control) device, and it is also possible to use a modern control theory such as a robust control theory.

In the drive control method which has been explained up to now, drive control is carried out with reference to the angular speed deviation value at the present drum position of one rotation before while the angular speed deviation profile in the storage (RAM) is constantly renewed; therefore, the angular speed fluctuation tends rapidly to the minimum and as the result, the photoreceptor drum is rotated at a constant angular speed.

Further, as regards the acquisition of the above-mentioned angular speed deviation profile, it is not desirable to do it immediately after the start of the rotation of the drive motor 60. In order to make the rotation reach to a constant angular speed in a short time, it is necessary that the acquisition of the profile is carried out after the passage of the waiting time from the timing when the drive motor 60 reaches to the target standard angular speed to the timing when the mechanical vibration generated at the time of mechanical acceleration is subsided.

Figure 5:
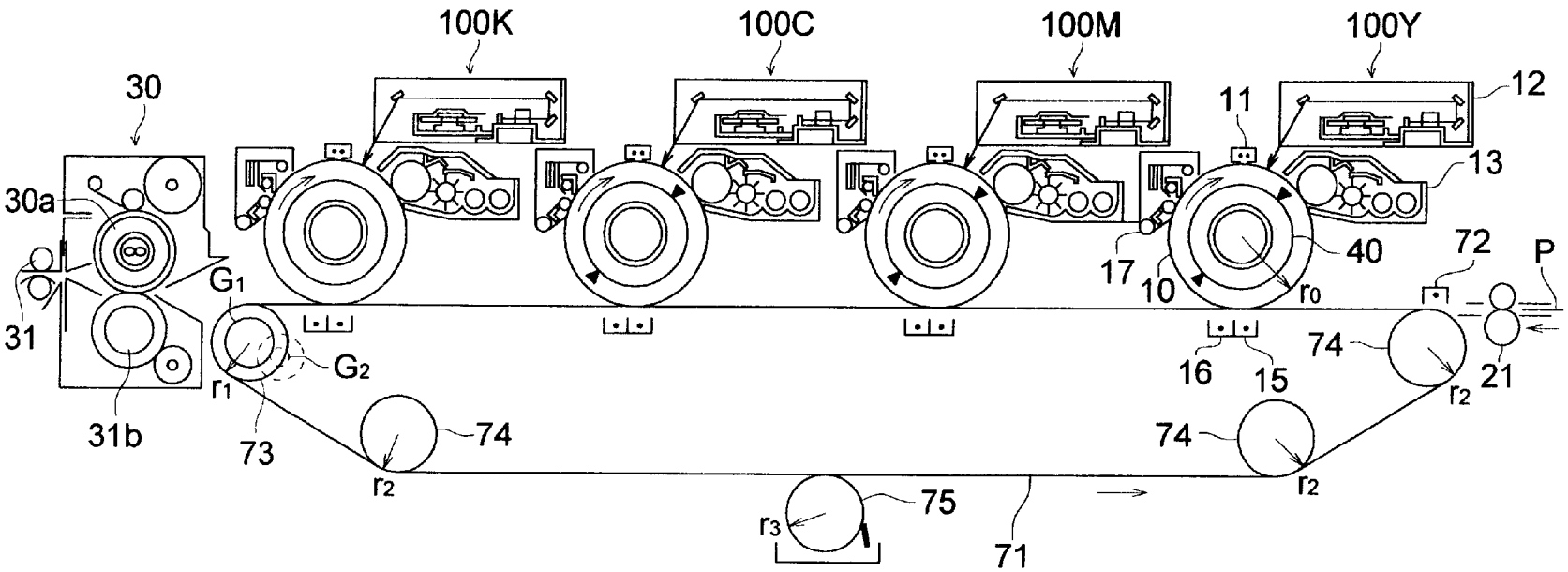
FIG. 5 is a cross-sectional view of a color image forming apparatus.

By applying the rotational speed control method explained in the above to the image forming apparatus shown in FIG. 1, a good high-precision constant angular speed control can be made, and a good-quality image having no positional deviation can be obtained; further, by applying it to the tandem-type color image forming apparatus shown in FIG. 5, the effect of a rotational speed control method of this invention is made more remarkable.

In the color image forming apparatus shown in FIG. 5, there are provided around the periphery of an intermediate transfer belt 71 four sets of process unit 100 consisting of a yellow (Y), a magenta (M), a cyan (C), and a black (K) unit, and Y, M, C, and K toner images are formed in their respective process units 100. The formed toner images of Y, M, C, and K are sequentially transferred superposed onto a transfer paper sheet P which is synchronously conveyed by a pair of registration rollers 21 and closely attracted to the intermediate transfer belt 71 by a paper charging device 72 to be conveyed, and are fixed to it by a fixing device 30; then, the paper sheet is ejected to the outside of the machine by a pair of ejection rollers 31.

In the above-mentioned color image forming apparatus, the process units 100Y, 100M, 100C, and 100K are all of the same shape and of the same structure except that they have respective developers of different colors contained in their respective developing devices 13; in each of the process units 100, in the same way as the image forming apparatus shown in FIG. 1, image formation is carried out by means of a charging device 11, an image exposure device 12, the developing device 13, and a repetitive control of rotational fluctuation is performed by an encoder 40 mounted on the drum shaft, by which the angular speed control of each photoreceptor drum 10 is carried out. At this time, by setting the standard angular speed at the same value for each process unit 100, color toner images of Y, M, C, and K, as long as they have the same shape in the original image, are formed to have the same shape and by superposing the toner images in synchronism with one another, a good color image can be obtained.

In the tandem-type color image forming apparatus explained in the above, with a structure such that the photoreceptor drum 10 and the intermediate transfer belt 71 are pressed to be in contact with each other by a certain constant pressure, the fluctuation of movement of the intermediate transfer belt unit is transmitted to the photoreceptor drum.

It is important in carrying out a repetitive control to make the angular speed of the photoreceptor drum 10 constant at a high precision that the profile during one rotation of the drum in the case where rotation control is not practiced comes to be in the same state every time to have a reproducibility. The inventors of this invention confirmed experimentally that the fluctuation of the rotation of the photoreceptor drum 10 influenced by a member provided around its periphery can be suppressed by establishing a relationship that the diameter of the photoreceptor drum 10 is made an integral multiple of the diameter of a rotary member which is directly or through the intermediate transfer belt 71 in contact with it.

In the color image forming apparatus shown in FIG. 5, for a drive roller 73 engaging with the intermediate transfer belt 71 and rotating to drive it, a driven roller 74 engaging with the intermediate transfer belt 71 and rotating driven by it, and a cleaning roller 75 engaging with the intermediate transfer belt 71 and carrying out the removing of the toner particles attaching to the belt, with the radius of the photoreceptor drum 10 denoted by $r_0$, the radius of the drive roller 73 denoted by $r_1$, the radius of the driven roller 74 denoted by $r_2$, and the radius of the cleaning roller 75 denoted by $r_3$, if there is a relationship that $r_1/r_0=N_1$, $N_1=1, 2, 3, - - - , n$, $r_2/r_0=N_2$, $N_2=1, 2, 3, - - - , n$, $r_3/r_0=N_3$, $N_3=1, 2, 3, - - - , n$, and further, if there is the following relationship between the gear $G_1$ directly coupled to the drive roller 73 and the gear $G_2$ which engages with the gear $G_1$ and is mounted to the shaft of the drive motor, $G_1/G_2=N_4$, $N_4=1, 2, 3, - - - , n$, the fluctuation of the rotation of the photoreceptor drum 10 influenced by the members provided around its periphery can be suppressed with certainty, and it becomes possible to make a high-precision angular speed control at a constant speed at a low cost.

Figure 6:
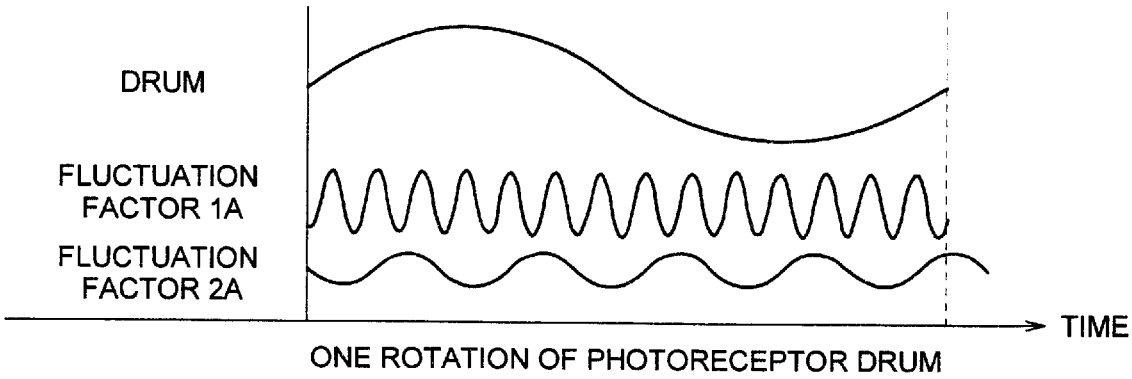
FIGS. 6(*a*) and 6(*b*) are explanatory drawings showing whether or not there is reproducibility of the profile of a photoreceptor drum.
Figure 6:
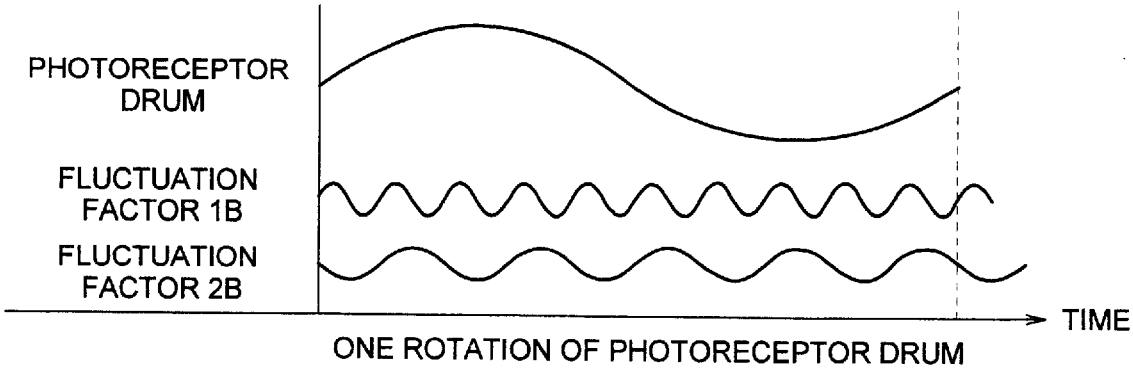

FIG. 6 is an explanatory drawing schematically showing the state where the one rotation profile of the photoreceptor drum 10 is repeated with reproducibility (FIG. 6(*b*)), and the state where it is not repeated (FIG. 6(*a*)); FIG. 6(*a*) shows that the reproducibility of the one rotation profile is lost by the integral multiple of the radius of any one of the members provided around the periphery (for example, drive roller 73, driven roller 74, etc.) being unequal to the radius of the photoreceptor drum 10 (fluctuation factors 1A and 2A), and FIG. 6(*b*) shows that the reproducibility of the one rotation profile of the drum is maintained by an integral multiple of the radius of every member provided around the periphery being equal to the radius of the photoreceptor drum 10 (fluctuation factors 1B and 2B).

By employing a drive control method of a photoreceptor drum of this invention, a repetitive control of the rotational fluctuation of a photoreceptor drum is performed, and the rotational fluctuation is suppressed at a high precision in a short time, which makes it possible to carry out a constant angular speed rotation.

Further, by making the structure such that an integral multiple of the radius of a member provided around the periphery of the photoreceptor drum is equal to the radius of the photoreceptor drum, the fluctuation factor influenced by the member provided around the periphery can be suppressed with certainty and a high-precision drive control is to be performed.

Figure 7:
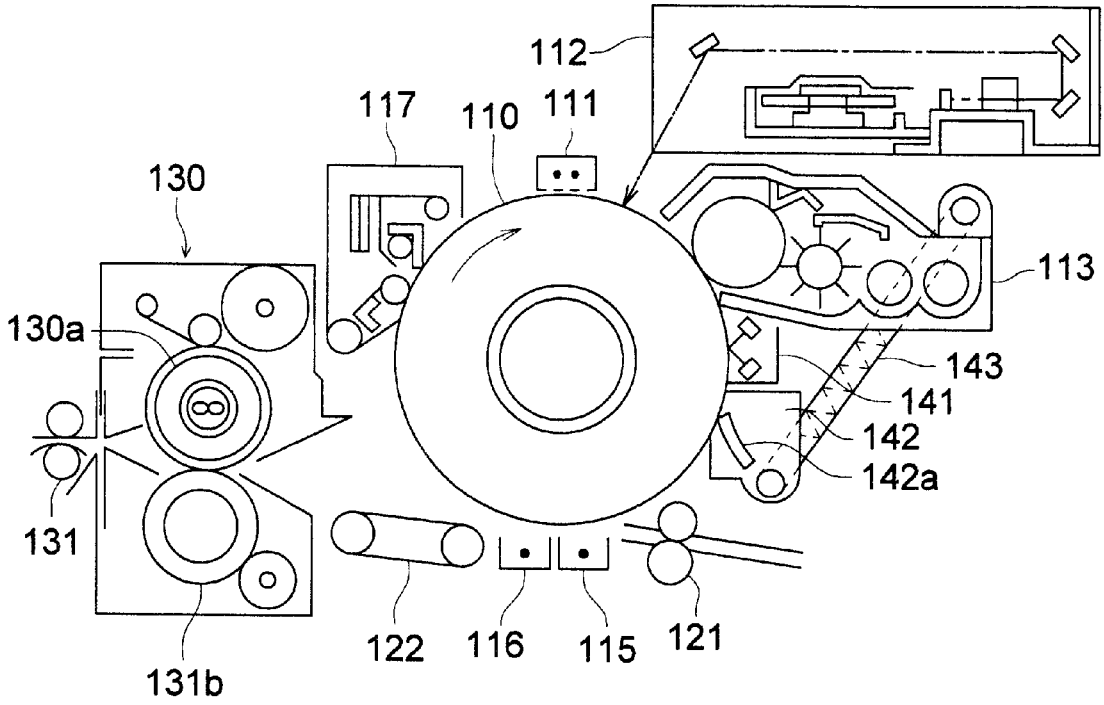
FIG. 7 is a cross-sectional view of the structure of a second image forming apparatus of this invention.

In the image forming apparatus shown in FIG. 7, there are provided a mark writing means for writing marks at constant intervals on a photoreceptor drum 110 in order to practice a rotational speed control, and a mark detecting means for making it possible to read the written marks at any time. The mark writing means may be provided independently, but it is also possible to make an image exposure device 112 for carrying out image exposure have also the function of the mark writing means; the marking record is written in non-image forming area of the photoreceptor drum 110, that is, in the neighborhood of its side surface outside the image forming area on the circumferential surface of the drum at constant time intervals.

The latent image of the written marks is developed by the developing device 113 to become a visible mark image, and the reading of the intervals of the visualized marks is continually carried out by a detection sensor 141 positioned at the downstream side with respect to the drum rotation. For the mark detection sensor 141, a photo-coupler composed of a light emitting element and a light receiving element is used, and the detection of the mark intervals is made on the basis of the difference of the intensity of the reflected light at the mark part.

In the downstream side of the mark detection sensor 141 before the transfer region, a cleaning device dedicated to the marks only 142 for carrying out the cleaning of the mark part only is provided, to carry out the cleaning of the mark part which has become an visual image. The cleaning is practiced with a cleaning blade 142*a* brought in a rubbing contact with the photoreceptor surface, and the blade 142*a* is always kept in rubbing contact with the photoconductor surface during the rotation of the photoreceptor drum 110, to perform the cleaning of the mark part. The toner particles accumulated in the cleaning device dedicated to the marks only 142 by the practice of cleaning are conveyed to the inside of the developing device 113 by a conveyance screw 143 rotating inside a pipe; thus, toner recycling is carried out.

Figure 8:
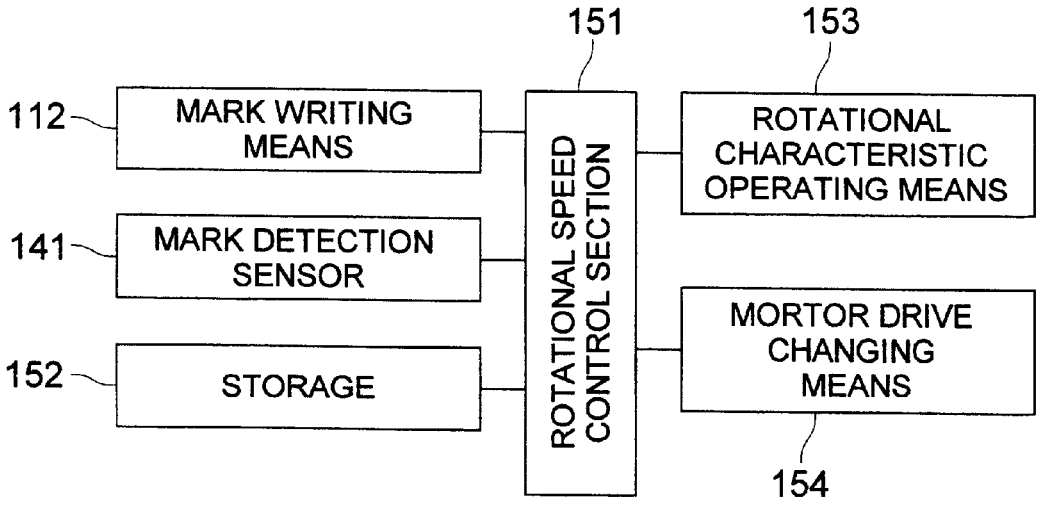
FIG. 8 is a control block diagram for practicing rotational peripheral speed control.
Figure 9:
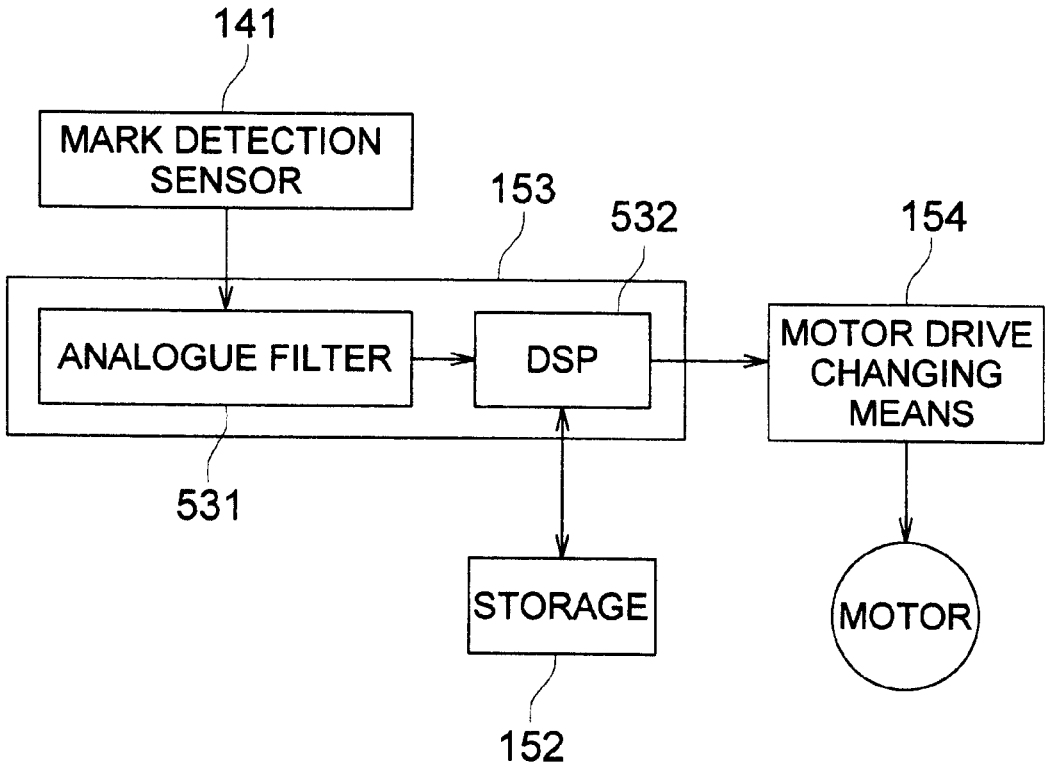
FIG. 9 is a circuit diagram showing the flow of a signal.

As regards the image forming apparatus explained in the above, a control block diagram for practicing the rotational speed control of the photoreceptor drum 110 is shown in FIG. 8, and a circuit diagram showing the flow of a signal is shown in FIG. 9.

The image exposure device 112 continually carries out mark formation in the non-image area on the photoreceptor drum 110 at constant time intervals $t_0$ during image formation. Besides, as regards the recorded mark time interval $t_0$, because the human eye has a high response in the neighborhood of 1 Line/mm on the spatial frequency response curve concerning the resolution of the human eye, the detection of the rotational fluctuation of the photoreceptor drum 110 is carried out with $t_0$ changed in accordance with the peripheral speed in such a way as to be equal to 1/200 Hz at the peripheral speed 200 mm/sec, and to 1/100 Hz at the peripheral speed 100 mm/sec. Further, in the case where the photoreceptor drum 110 rotates at a low speed, for the reason of the signal processing being easy at low speed, and for the purpose of lowering toner consumption, it is put into practice that the time interval of mark recording is made to be longer as compared to the case of high-speed rotation. In this example of the embodiment, it is practiced to provide a marking time switching means for switching the marking time interval in accordance with the number of revolutions of the photoreceptor drum 110.

The recorded mark signal is read by the mark detection sensor 141. The time interval values of the read mark signal are recorded in a storage 152. On the basis of the mark signal stored in the storage 152, the rotational characteristic of the photoreceptor drum 110 is calculated by a rotational characteristic operation processing means 153. In the rotational characteristic operation processing means 153, the removal of noises is carried out, and a high-speed high-precision operation processing is practiced by a digital filter processing device DSP532 which performs feedback control and feed-forward control.

The marking time interval information recorded in the storage is used in the rotational peripheral speed control at the next rotation of the photoreceptor drum 110. As regards the rotational peripheral speed control, it is practiced that the characteristic values of the photoreceptor drum 110 stored in the storage 152 are renewed in real time while the delay of reading between the mark writing position and the mark detecting position is being corrected.

The time delay value in calculating a motor drive order value of a motor drive changing means 154 from the rotational characteristic values stored in the storage is calculated in the following way. That is, the rotational delay value can be calculated by practicing a division operation (x/v) such that the interval x between the mark writing position and the mark detecting position on the photoreceptor drum 110 is divided by the standard peripheral speed v of the photoreceptor drum 110. In other way, for the photoreceptor drum 110 rotating at the standard peripheral speed v, by counting the number of pulses sent out by the mark writing means 112 before a mark signal which has been written by the mark writing means 112 with a time interval $t_0$ reaches the mark detection sensor 141, the rotational delay value can be calculated as $t_0 \times n$.

In this invention, a rotational peripheral speed control is carried out by the use of the characteristic values based on the mark interval values which have been read during the previous rotation and stored in the storage 152, while the time delay from the mark writing position to the mark detecting position is being corrected, and also a control to make the characteristic values stored in the storage 152 renewed in real time is done; by making such controls, the rotational peripheral speed fluctuation of the photoreceptor drum 110 is rapidly tends to the minimum by the continuing of the rotation control, which makes it possible to perform a constant peripheral speed rotation.

Figure 10:
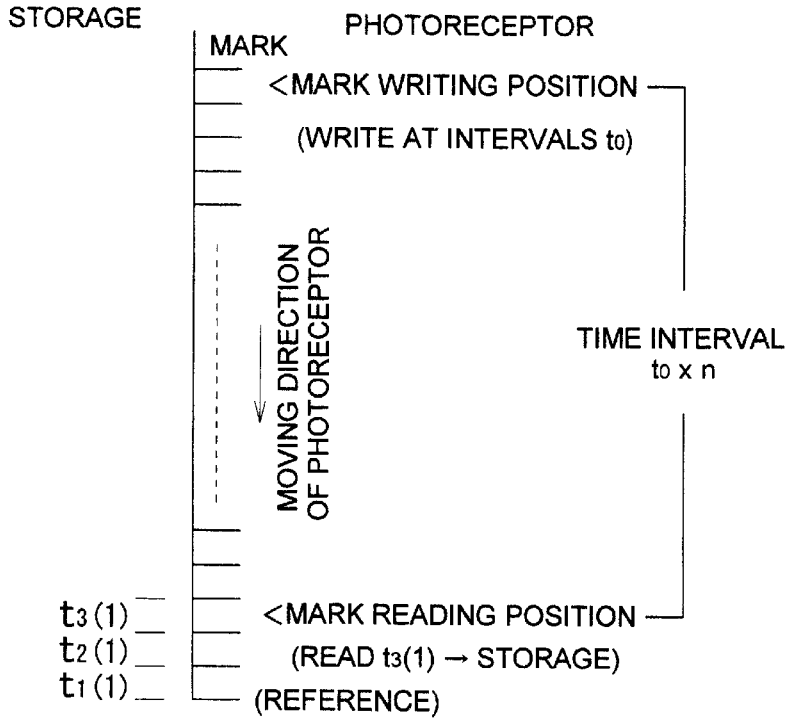
FIGS. 10(*a*) and 10(*b*) are explanatory drawings concerning a concrete example of a peripheral speed control.
Figure 10:
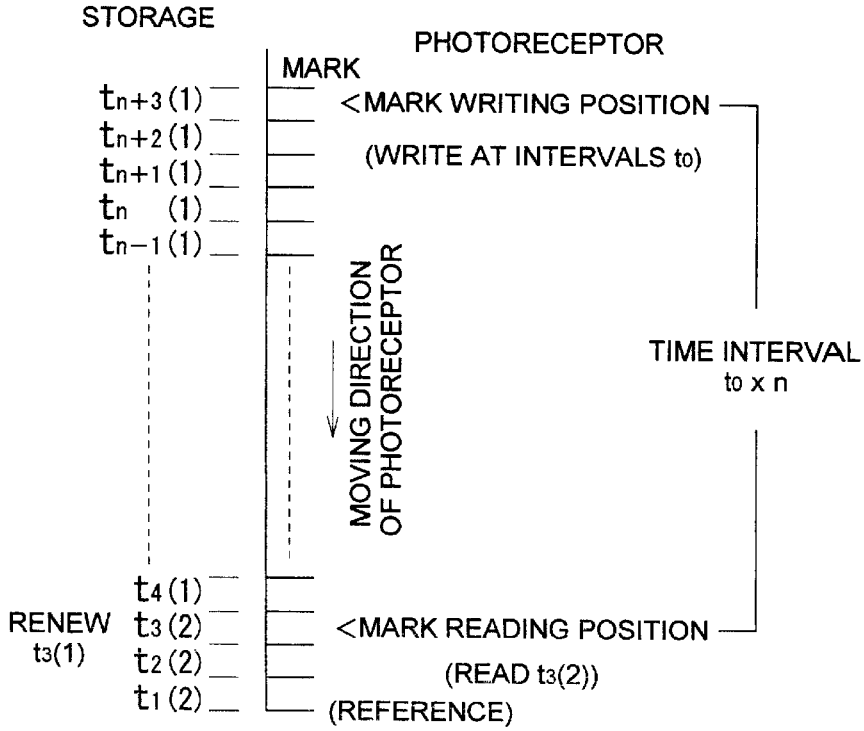

A concrete example of the peripheral speed control explained in the above will be explained with the explanatory drawing shown in FIG. 10 referred to. In FIG. 10(*a*) and FIG. 10(*b*), in the right-hand side, the part including the mark writing position and the mark reading position on the circumferential surface of the photoreceptor drum 110 is shown in an exploded state, and in the left-hand side, it is shown the memory interval information stored in the storage 152 in correspondence to the mark intervals on the drum circumferential surface. The mark writing means carries out writing at constant time intervals $t_0$, and it is shown in the drawing the case where the rotational delay value from the mark writing position to the mark reading position is $t_0 \times n$. A reference position is provided on the circumferential surface of the photoreceptor drum 110 for the ease of explanation, and supposing that the mark writing is started from the reference position, the representation is made with the time interval up to the time the mark written at first is read by the mark detection sensor 141 denoted by $t_1$, and the time interval for the second one denoted by $t_2$, - - - .

FIG. 10(*a*) shows the state of mark writing and mark reading during the first rotation of the drum, and FIG. 10(*b*) shows the state during the second rotation at the same rotational position of the drum. In the first rotation of the photoreceptor drum 110, only mark writing at the intervals $t_0$ and reading of the marking time intervals $t_1(1)$, $t_2(1)$, $t_3(1)$, - - - are carried out, and no peripheral speed control is made (FIG. 4(*a*)).

In the second rotation of the drum, together with mark writing at the intervals $t_0$ and reading of the marking time intervals of the second rotation $t_1(2)$, $t_2(2)$, $t_3(2)$, - - - by the mark detection sensor 141, the peripheral speed control and the renewal of the mark interval information in the storage 152 to new mark interval information are carried out. That is, as for the peripheral speed control, it is done for $(t_{n+1}(1)/t_0)$, $(t_{n+2}(1)/t_0)$, $(t_{n+3}(1)/t_0)$, - - - with the delay of reading corrected. Further, as for the renewal of the mark interval information to new information, a real-time renewal of $t_1(1)$ to $t_1(2)$, $t_2(1)$ to $t_2(2)$, $t_3(1)$ to $t_3(2)$, - - - is carried out.

As regards the control on and after the third rotation of the photoreceptor drum 110, by practicing the same peripheral speed control and renewal of the mark interval information, a uniform and good constant peripheral speed control is to be carried out.

By the application of the rotational speed control method explained in the above to the image forming apparatus shown in FIG. 1, a good high-precision constant peripheral speed control can be performed without any increase of cost in comparison with the method based on an encoder, and a good-quality image having no positional deviation can be obtained; further, by applying it to the tandem-type color image forming apparatus shown in FIG. 5, the effect of a rotational speed control method of this invention is made more remarkable.

Figure 11:
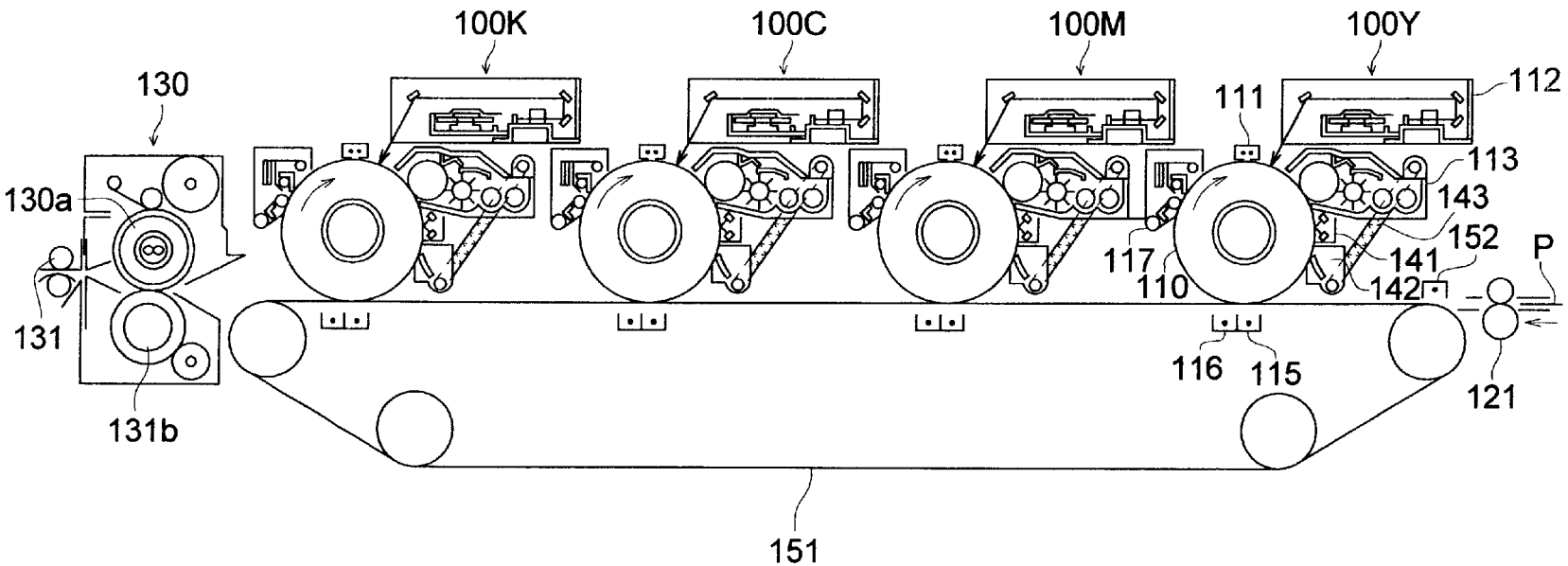
FIG. 11 is a cross-sectional view showing the structure of a color image forming apparatus.

In the color image forming apparatus shown in FIG. 11, there are provided around the periphery of a transfer belt 151 four sets of process unit 100 consisting of a yellow (Y), a magenta (M), a cyan (C), and a black (K) unit, and Y, M, C, and K toner images are formed in the respective process units 100. The formed toner images of Y, M, C, and K are sequentially transferred superposed onto a recording paper sheet P which is synchronously conveyed by a pair of registration rollers 121 and closely attracted to the transfer belt 151 by a paper charging device 152 to be conveyed, and are fixed to it by a fixing device 130; then, the paper sheet is ejected to the outside of the machine by a pair of ejection rollers 131.

In the above-mentioned color image forming apparatus, the process units 100Y, 100M, 100C, and 100K are all of the same shape and of the same structure except that they have respective developers of different colors contained in their respective developing devices 113; in each of the process units 100, in the same way as the image forming apparatus shown in FIG. 7, a peripheral speed control of each photoreceptor drum 110 is performed by an image exposure device 112 having a function of mark writing and a mark detection sensor positioned at the downstream side beyond the developing device 113. At this time, by setting the standard angular speed at the same value for each process unit 100, color toner images of Y, M, C, and K, as long as they have the same shape in the original image, are formed to have the same shape and by superposing the toner images in synchronism with one another, an extremely good color image can be obtained. Further, in each of the process units 100, a cleaning device dedicated to marks only 142 provided at the downstream side of the mark detection sensor 141 carries out the removal of toner particles on the mark part, and the toner particles collected by the cleaning process are conveyed and returned to the inside of the developing device 113 containing a toner of the same color as the collected toner particles by a conveyance screw 143. Hence, no concern about the increase of toner consumption becomes necessary even by recording the marks.

The color image forming apparatus explained in the above has a structure such that toner images formed in their respective process units 100 are transferred superposed on a transfer material; however, also for a color image forming apparatus of a type such that toner images formed in their respective process units 100 are once transferred onto an intermediate transfer belt superposed, and the color toner images superposed on the intermediate transfer belt are again transferred onto a transfer material, by the application of a rotational speed control method of this invention to each of the process units, an excellent effect can be obtained.

Further, a rotational speed control method of this invention is not to be limited to an image forming apparatus using the photoreceptor drum 110 explained in the above, but an excellent effect can be obtained in the same way also by the application of it to an image forming apparatus using a belt-shaped photoreceptor to form a toner image on a belt, or to an image forming apparatus using the above-mentioned intermediate transfer belt.

By employing a rotational speed control method of this invention, without the use of an encoder which has heretofore been used, it becomes possible to make a peripheral speed control for a rotary body such as a photoreceptor drum or belt at a high precision, and because a resolution adapted to the peripheral speed of the rotary body can be selected, not only it has an economical advantage but also it is capable of a high-precision peripheral speed control.

An image forming apparatus of this invention has the above-mentioned effect by using a rotational speed control method of this invention, and at the same time, because toner particles of the marks produced for detection are collected and returned to the developing device, the concern that toner consumption may be increased is also removed.

What is claimed is:

1. An apparatus for forming an image, comprising:

a photoreceptor drum to form a toner image on its circumferential surface;

a motor to drive said photoreceptor drum;

a mark writing device to intermittently write each of marks on said photoreceptor drum at constant time intervals;

a mark detecting device to detect each of said marks written by said mark writing device;

a storage section to store mark-interval values between said marks detected by said mark detecting device;

an arithmetic processing section to calculate rotational characteristics of said photoreceptor drum from said mark-interval values stored in said storage section; and a controlling section to control said motor, based on said rotational characteristics of said photoreceptor drum, calculated by said arithmetic processing section, so as to keep a circumferential surface velocity of said photoreceptor drum as uniform as possible.

2. The apparatus of claim 1, further comprising:

a mark cleaning device to clean said marks, written by said mark writing device and developed with toner on said circumferential surface of said photoreceptor drum, before transferring said toner image onto a recording medium; and a toner recycling section to collect toner cleaned by said mark cleaning device and to convey said toner to a developing section so as to reuse said toner for developing.

3. The apparatus of claim 1, wherein a full color toner image is formed by overlapping a plurality of unicolor toner images on an intermediate transfer belt or a recording medium, and each of said plurality of unicolor toner images is formed by each of a plurality of unicolor image forming units included in said apparatus; and wherein said photoreceptor drum is employed for each of said plurality of unicolor image forming units.

4. The apparatus of claim 1, further comprising:

an image exposing section to expose an image onto said photoreceptor drum, so as to form a latent image, which is developed with toner to form said toner image;

wherein said image exposing section also serves as said mark writing device.

5. The apparatus of claim 1, wherein said marks are written on a non image-forming area of said photoreceptor drum.

6. The apparatus of claim 1, further comprising:

a time interval changeover section to change a value of said constant time intervals, at which each of said marks is intermittently written, corresponding to a rotational frequency of said photoreceptor drum.

7. A method of controlling a motor for driving a rotational body, comprising the steps of:

intermittently writing each of marks on said rotational body at constant time intervals by means of a mark writing device; detecting each of said marks, written by said mark writing device, by means of a mark detecting device;

storing mark-interval values between said marks detected by said mark detecting device in a storage section;

calculating rotational characteristics of said rotational body from said mark-interval values stored in said storage section by means of an arithmetic processing section; and controlling said motor by means of a controlling section, based on said rotational characteristics of said rotational body, calculated by said arithmetic processing section, so as to keep a circumferential surface velocity of said rotational body as uniform as possible.

8. The method of claim 7, wherein said controlling section includes a motor-drive changing section to change a motor-drive command value, based on a calculation result of said arithmetic processing section.

9. The method of claim 8, wherein said controlling section controls said motor so as to compensate a delay time generated at a time when said motor-drive command value is calculated from said rotational characteristics of said rotational body, based on a reading delay time value, from a writing position at which a mark, being one of said marks, is written by said mark writing device, to a detecting position at which said mark is detected by said mark detecting device.

10. The method of claim 9, wherein said motor-drive changing section changes said motor-drive command value, based on said rotational characteristics of said rotational body calculated within a preceding one-revolution of said rotational body, so as to keep said circumferential surface velocity of said rotational body at a constant value.

11. The method of claim 10, wherein, during a velocity controlling operation for said rotational body, said mark writing device constantly writes each of said marks and said mark detecting device constantly detects each of said marks, and said mark-interval values stored in said storage section are revised in a real time base while said reading delay time value is compensated for, to continuously perform said velocity controlling operation for next revolution of said rotational body.

* * * * *